US006443773B1

(12) United States Patent
Korsunsky et al.

(10) Patent No.: US 6,443,773 B1
(45) Date of Patent: Sep. 3, 2002

(54) CABLE CONNECTOR HAVING PRE-ASSEMBLED TERMINAL MODULES

(75) Inventors: Iosif Korsunsky, Harrisburg, PA (US); Joanne E. Shipe, Harrisburg, PA (US); Wei-Chen Lee, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/082,992

(22) Filed: Feb. 25, 2002

(51) Int. Cl.[7] ..... H01R 33/00
(52) U.S. Cl. ..... 439/660; 439/98
(58) Field of Search ..... 439/660, 610, 439/98, 746, 747, 744

(56) References Cited

U.S. PATENT DOCUMENTS 4,740,173 A * 4/1988 Justiano et al. ..... 439/351
5,092,790 A * 3/1992 Justiano et al. ..... 439/351
5,961,348 A * 10/1999 Murphy ..... 439/108
6,045,408 A * 4/2000 Takemasa ..... 439/660
6,071,151 A * 6/2000 Igarashi ..... 439/660
6,179,632 B1 * 1/2001 Wu et al. ..... 439/660
6,183,315 B1 * 2/2001 McHugh et al. ..... 439/660
6,280,261 B1 * 8/2001 Sakurai ..... 439/746

* cited by examiner

*Primary Examiner*—Tho D. Ta
*Assistant Examiner*—Edwin A. León
(74) *Attorney, Agent, or Firm*—Wei Te Chung

(57) ABSTRACT

A cable connector includes an insulative housing (10), a pair of individual terminal modules (12) assembled to the housing, a cable end (14) connected to the terminal modules, an insulator (16) located between the terminal modules and a cover (18) over-molded to the housing and together with the housing enclosing the cable end and the terminal modules. The housing defines two slots (30). Each terminal module includes an insulative base (32), a number of terminals (34) and a grounding blade (38) attaching to the base. The cable end includes a number of conductive cores (60) and a corresponding number of metal webs (62) circling respective conductive cores. The conductive cores are electrically connected to corresponding terminals and the metal webs are electrically connected to corresponding grounding blades. The terminal modules are inserted into the corresponding slots after the terminals and the grounding blades are attached to the insulative base. The insulator located between the two rows of terminals and bearing against the cables to prevent the two rows of terminals drawn by the cables from tipping toward each other.

10 Claims, 4 Drawing Sheets

CABLE CONNECTOR HAVING PRE-ASSEMBLED TERMINAL MODULES

BACKGROUND OF THE INVENTION

1. Field of the Invention

The present invention relates to a connector having pre-assembled terminal modules, and particularly to a cable connector having means for securely retaining the pre-assembled terminal modules to an insulative housing of the connector.

2. Description of the Related Art

Currently, cable connectors available for mass production require handling all contacts within a connector body first and then terminating all cables directly to the respective contacts or indirectly to the respective contacts via a printed circuit board in the connector body. It permits termination of a small number of wires in a more open area with easier access to the termination area and allows for less complicated assembly of cable connectors. It does not suit complicated cable connectors having a small dimension and a large number of wires because it is difficult to terminate the cables to the respective contacts directly or indirectly in the connector body.

However, higher speed, higher density and more complicated cable connectors may have a large number of signal contacts and grounding terminals/buses for protecting the signals transmitting through the signal contacts. It is not convenient or economical to handle so many contacts into the connector body and then terminate a same number of wires to corresponding contacts. If one or more of the contacts are not correctly handled into the connector housing or correctly terminated to the corresponding wires, rework is difficult and costly and the cable connector may be discarded. This invention is aimed at addressing the above issue.

SUMMARY OF THE INVENTION

A first object of the present invention is to provide a cable connector having pre-assembled terminal module for facilitating the assembly of terminals thereof into an insulative housing thereof;

A second object of the present invention is to provide a cable connector having means for preventing terminals thereof from tipping; and A third object of the present invention is to provide a convenient and economy method of assembling a cable connector.

To obtain the above object, a cable connector comprises an insulative housing, a pair of individual terminal modules assembled to the housing, a cable end connected to the terminal modules, an insulator located between the terminal modules and a cover over-molded or mechanically joined to the housing. The housing defines two slots. Each terminal module includes an insulative base, a plurality of terminals and multiple grounding blades attached to the insulative base. The cable end includes a number of conductive cores and a corresponding number of metal webs circling corresponding conductive cores. The conductive cores are electrically connected to corresponding terminals and the metal webs are electrically connected to corresponding grounding blades. The terminal modules are inserted into the corresponding housing slots after the terminals and the grounding blades are assembled to the insulative base after the cable is terminated. The insulator is located between the spaced grounding blades and bears against rear portions of the grounding blades to prevent one row of terminals from tipping toward the other row.

Other objects, advantages and novel features of the invention will become more apparent from the following detailed description of the present embodiment when taken in conjunction with the accompanying drawings.

DESCRIPTION OF THE PREFERRED EMBODIMENT

Figure 1:
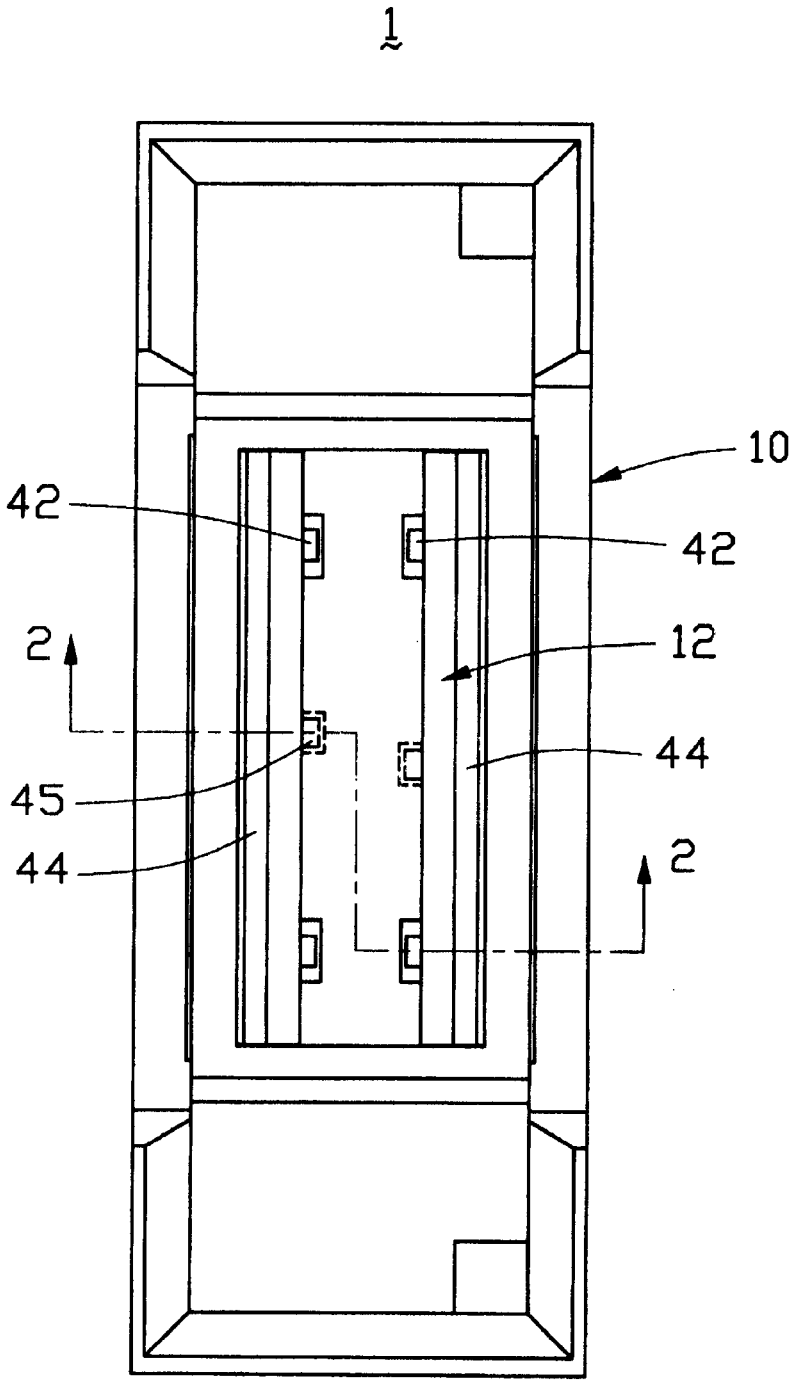
FIG. 1 is a planar view of a mating surface of a cable connector in accordance with the present invention.
Figure 2:
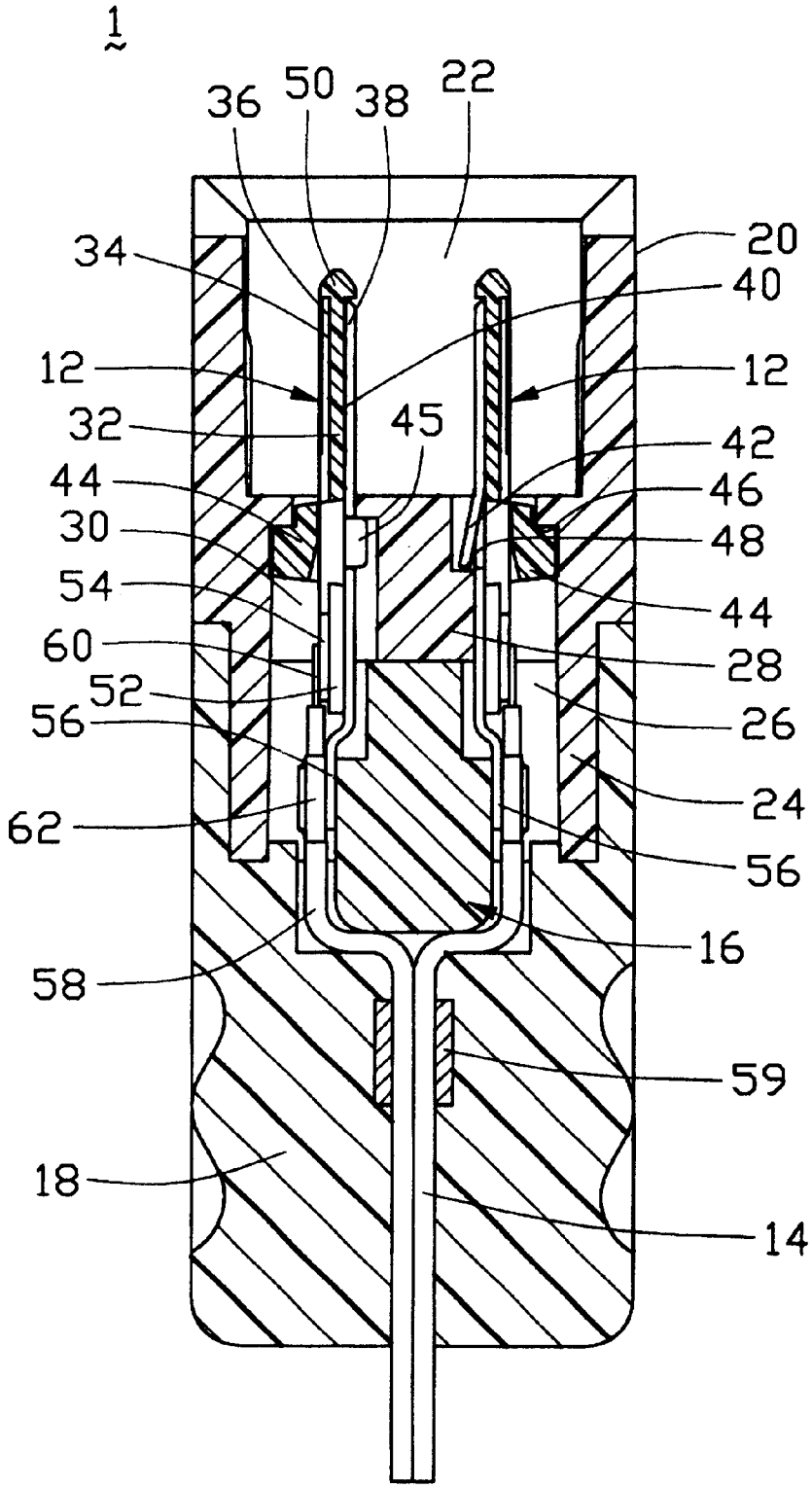
FIG. 2 is a cross-sectional view of the cable connector along line 2—2 of FIG. 1.
Figure 3:
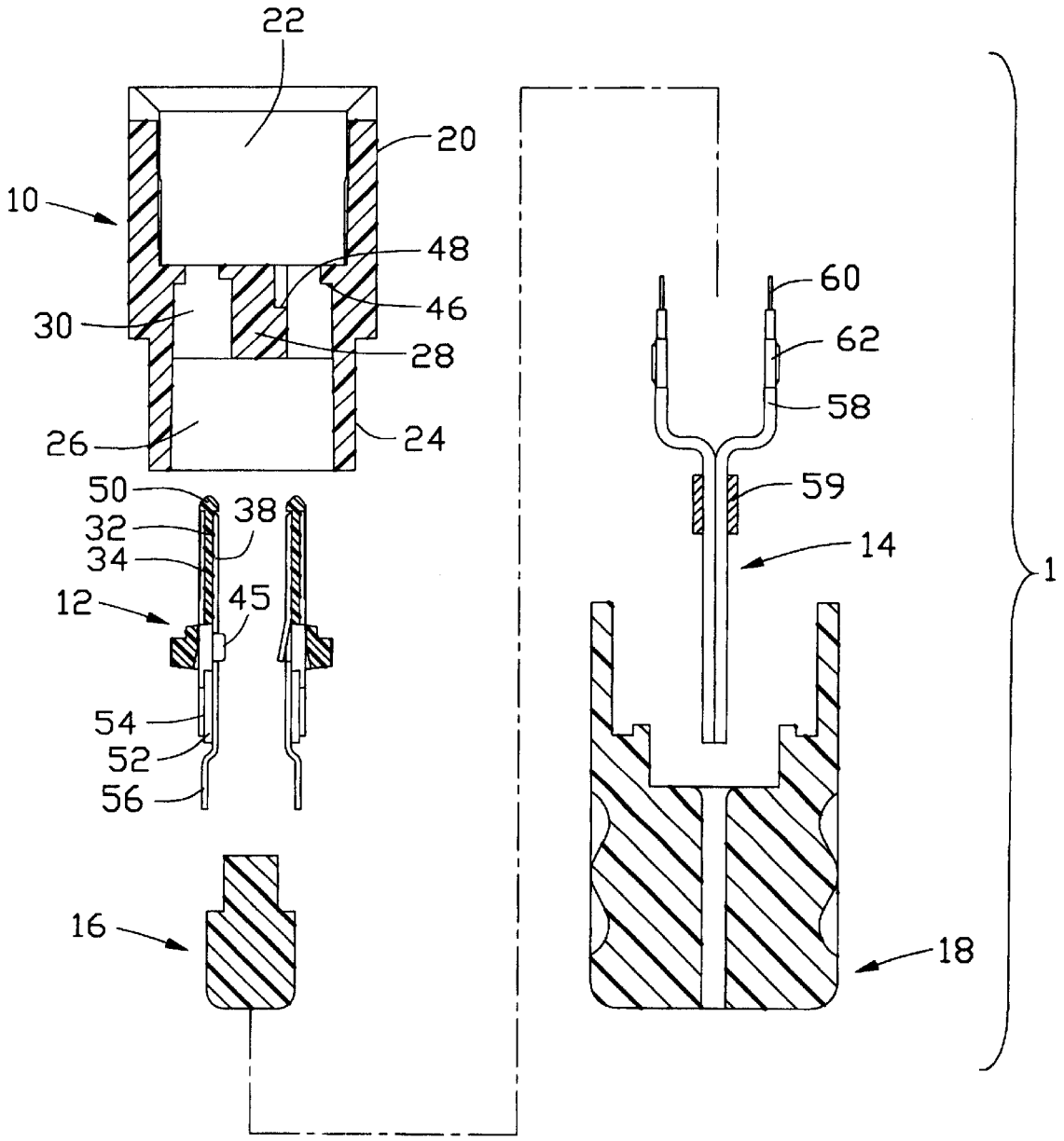
FIG. 3 is a disassembled view of FIG. 2.
Figure 4:
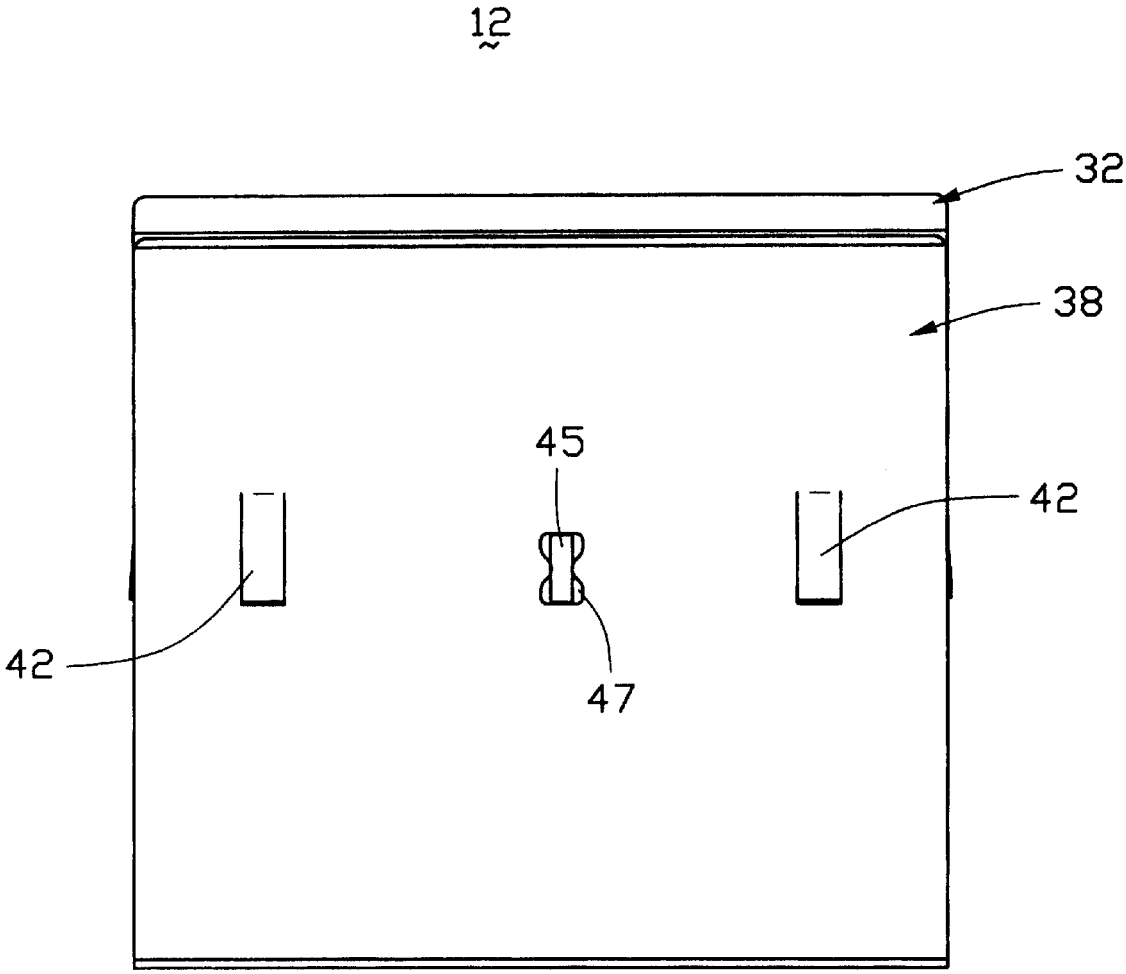
FIG. 4 is an enlarged planar view of a terminal module of the connector.

Referring to FIGS. 1–4, a cable connector 1 in accordance with the present invention comprises an insulative housing 10, individual terminal modules 12 assembled to the housing 10, a cable end 14 including a plurality of cables in two rows connected to the terminal modules 12, an insulator/spacer 16 located between the two rows of cables and a cover 18 assembled to the housing 10 for securing the insulator 16 and the cable end 14. The housing 10 includes a front portion 20 defining a mating port 22 for receiving a mating connector (not shown) therein, a rear portion 24 defining a room 26, and a middle portion 28 defining two slots 30. Each terminal module 12 includes an insulative base 32, a plurality of signal terminals 34 and a grounding blade 38 respectively attaching to opposite surfaces of the base 32. The grounding blades 38 each provide a pair of tabs 42 deflecting away from the insulative base 32 and a notch 47 at a location between the pair of tabs 42. The base 32 provides an elongated rib 44 on one of the opposite surfaces thereof and a block 45 on the other of the opposite surfaces. The block 45 is fixedly inserted through the notch 47 thereby retaining the grounding blade 38 to the insulative base 32. The tabs 42 and the ribs 44 respectively bear against shoulders 48, 46 in the middle portion 28 facing forwardly and rearwardly thereby retaining the terminal module 12 to the middle portion 28 of the housing 10. After attachment to the housing 10, a front end 50 and a rear end 52 of the terminal modules 12 respectively extend into the mating port 22 and the room 26 of the housing 10. Each terminal 34 has a tail portion 54 and each grounding blade 38 has a rear portion 56 both rearwardly extending into the room 26 of the housing 10.

The cable end 14 includes a plurality of cables 58 arranged in two rows and a strain-relief 59 for bundling the cables 58 together. Each cable 58 includes a conductive core 60 and a metal web 62 isolated from and surrounding the core 60. The cores 60 are electrically connected to the tail portions 54 of the terminals 34 by soldering or insulation displacement contact (IDC) connection. The metal webs 62 are electrically connected to the rear portions 56 of the grounding blades 38 by soldering or IDC connection. The insulator 16 is located between the rear ends 52 of the terminals 36 and bears against the rear portions 56 of the grounding blades 38 to prevent the rear ends 52 of the terminal modules 12 pulled by the cables 58 from tipping toward each other. The cover 18 is over-molded or mechanically attached to the rear portion 24 of the housing 10 after the terminal modules 12, the cable end 14 and the insulator 16 are assembled to the housing 10 and encloses the terminal modules 12, the cable end 14 and the insulator 16 between the cover 18 and the housing 10.

In assembly, the terminals 34 and the grounding blades 38 are first attached to corresponding bases 32 to constitute the terminal modules 12. The cables 58 are then electrically connected to corresponding terminals 58 and grounding blades 38 of the two terminal modules 12. After that, the terminal modules 12 together with the cables 58 are pushed into the housing 10. After that, the insulator 16 is located between the two rows of cables 58 and the strain-relief 59 is attached to the cables 58 and bundling the cables 58 together. Finally, the cover 18 is attached to the housing 10.

The insulator 16 is preferably manufactured individually, i.e., apart from the housing 10. However, the insulator 16 can also be unitarily manufactured with the housing 10 as long as it does not disturb the assembly of the terminal modules 12 together with the cable end 14 to the housing 10. The base 32 is preferably manufactured individually, i.e., apart from the housing 10. However, the base 32 can also be unitarily manufactured with the housing 10 to form an insulative member and the terminals 34 and the grounding blades 38 are assembled to the insulative member.

Comparing with the prior arts, this invention has the following advantages. To form terminal modules first and then insert the terminal modules 12 to the housing 10 is much easier than to insert the terminals 34 to the housing 10 directly. To electrically connect the cables 58 to corresponding terminals 34 outside of the housing 10 is much easier than inside the housing 10 because the operation is not limited by the housing 10 no matter how small the housing is. Thus, the cost of the connector of this invention is much lower than that of the prior arts.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector comprising:

an insulative housing;

at least one separate terminal module including an insulative base and a plurality of terminals attached to the insulative base;

a plurality of cables each having a conductive core, the conductive cores being electrically connected to corresponding terminals of at least one separate terminal module prior to the at least one separate terminal module assembling to the insulative housing; and a cover attached to the housing, the insulative housing includes a front portion defining a mating port for receiving a mating connector, a rear portion defining a room and a middle portion defining at least one slot communicating with the mating port and the room, and wherein the at least one separate terminal module is fixedly received in the at least one slot of the housing and a front and a rear end thereof respectively extending into the mating port and the room and an insulator bearing against the rear end of the at least one terminal module for preventing the at least one terminal module from tipping.

2. The cable connector as claimed in claim 1 wherein the at least one separate terminal module includes at least one grounding element attached to the insulative base thereof, and wherein the cables each include a shield electrically connecting to the at least one grounding element.

3. The cable connector as claimed in claim 1 including a strain-relief bundling the cables together.

4. The cable connector as claimed in claim 1, wherein the middle portion of the housing provides two shoulders and the at least one terminal module provides two protrusions bearing against respective shoulders of the housing forwardly and rearwardly thereby retaining the at least one terminal module to the insulative housing.

5. The cable connector as claimed in claim 4, wherein one of the protrusions is a tab outwardly deflecting from the at least one grounding element and the other is a rib on the insulative base.

6. A cable connector comprising:

an insulative member;

two rows of terminals and at least one grounding element attached to the insulative member;

a cable end including a plurality of cables each having a conductive core and a shield circling a corresponding conductive core, the cables being arranged in two rows in accordance with the terminals and the conductive cores being electrically connected to tail portions of corresponding terminals, the shields being electrically connected to the at least one grounding element;

an insulator located between the two rows of cables for preventing the cables and bearing against the rear end of the insulative member from drawing one row of terminals toward the other row and for preventing the at least one terminal module from tipping; and a cover attached to the insulative member.

7. The cable connector as claimed in claim 6, wherein the insulative member includes an insulative housing and an insulative base separated from the insulative housing, the terminals and the at least one grounding element being attached to the insulative base prior to assembling to the insulative housing.

8. The cable connector as claimed in claim 7, wherein the insulative housing defines a mating port in a front portion thereof and a room in a rear portion thereof and wherein the terminals and the grounding element partially extend into the mating port and the room of the insulative housing.

9. The cable connector as claimed in claim 7 including a strain-relief bundling the cables together.

10. A cable connector comprising:

an insulative housing;

two discrete terminal modules oppositely disposed in said housing, each of said terminal module including an insulative base and plural pairs of signal terminals and grounding bars located on opposite sides of said base, the grounding bars of said two terminal modules being located between the signal terminals of said two terminal modules;

two rows of cables each having an inner conductive core and an outer coaxial metal web isolated from each other by insulative material therebetween;

said conductive core being mechanically and electrically connected to the corresponding signal terminal, and said metal web mechanically and electrically connected to the corresponding grounding bar; wherein a spacer bearing against the rear end of the two terminal modules for preventing the two terminal modules from tipping is located between said two rows of cables and substantially separates the grounding bars of said two opposite terminal modules.

* * * * *